US006942095B2

(12) United States Patent
Chen

(10) Patent No.: US 6,942,095 B2
(45) Date of Patent: Sep. 13, 2005

(54) TOOLBOX

(76) Inventor: Tsai-Ching Chen, No. 202, Lane 330, Sec. 7, Chang Lu Road, Pu Hsing Hsiang, Chang Hua Hsien (TW)

( * ) Notice: Subject to any disclaimer, the term of this patent is extended or adjusted under 35 U.S.C. 154(b) by 112 days.

(21) Appl. No.: 10/403,369

(22) Filed: Mar. 31, 2003

(65) Prior Publication Data

US 2004/0188279 A1 Sep. 30, 2004

(51) Int. Cl.[7] ..... B65D 85/28
(52) U.S. Cl. ..... 206/376; 206/372
(58) Field of Search ..... 206/216, 376–379, 206/1.5, 372–375, 349; 281/15.1

(56) References Cited

U.S. PATENT DOCUMENTS 3,074,539 A * 1/1963 Rogovin ..... 206/379
5,018,896 A * 5/1991 Vanni ..... 402/38
5,368,164 A * 11/1994 Bennett et al. ..... 206/373
5,570,784 A * 11/1996 Sidabras et al. ..... 206/378
5,716,153 A * 2/1998 Aiello ..... 402/46
5,893,457 A * 4/1999 Wei ..... 206/373
6,019,539 A * 2/2000 Lynton ..... 402/79
6,105,770 A * 8/2000 Vasudeva ..... 206/378
6,415,923 B1 * 7/2002 Chen ..... 206/379
6,547,074 B1 * 4/2003 Chen ..... 206/379

* cited by examiner

*Primary Examiner*—Derris H. Banks
*Assistant Examiner*—J Williams
(74) *Attorney, Agent, or Firm*—Alan D. Kamrath; Nikolai & Mersereau, P.A.

(57) ABSTRACT

A toolbox includes a first shell, a second shell, a holder and a binder. The second shell is connected with the first shell. The holder holds tools. The binder retains the holder in the shells in a releasable manner. The binder includes a first claw and a second claw for engagement with the first claw in order to clamp the holder.

15 Claims, 4 Drawing Sheets

TOOLBOX

BACKGROUND OF INVENTION

1. Field of Invention

The present invention relates to a toolbox for containing selective one of various sets of tools.

2. Related Prior Art

Taiwanese Patent Publication No. 461373 discloses a toolbox including a first shell 10, a second shell 11 and a holder 12. The holder 12 defines a plurality of recesses 13 in which tool bits 14 can be put. The shapes of the recesses 13 determine the types of the tool bits 14 that can be put in this toolbox. The holder 12 is pivotally connected with each of the shells 11 and 12 by means of a reduced portion 15. Therefore, once made, the holder 12 with a set of recesses 13 cannot be replaced with another holder with another set of recesses for holding another set of tool bits.

The present invention is therefore intended to obviate or at least alleviate the problems encountered in the prior art.

SUMMARY OF INVENTION

It is the primary objective of the present invention to provide a toolbox for containing selective one of various sets of tools.

According to the present invention, a toolbox includes a first shell, a second shell, a holder and a binder. The second shell is connected with the first shell. The holder holds tools. The binder retains the holder in the shells in a releasable manner.

Other objectives, advantages, and novel features of the invention will become more apparent from the following detailed description when taken in conjunction with the attached drawings.

BRIEF DESCRIPTION OF DRAWINGS

The present invention will be described through detailed illustration of embodiments referring to the attached drawings wherein.

DETAILED DESCRIPTION OF PREFERRED EMBODIMENT

Figure 1:
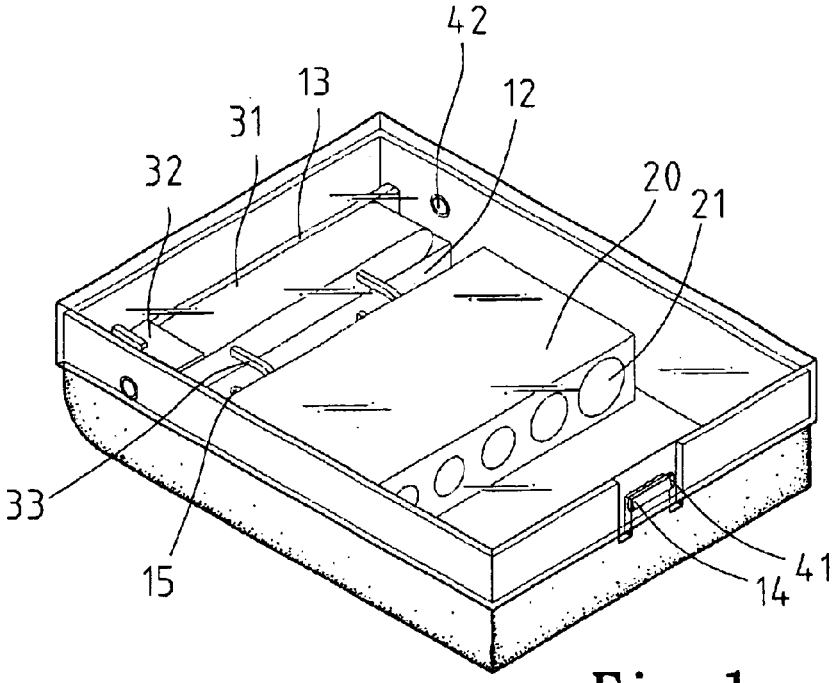
FIG. 1 is a perspective view of a toolbox for containing a set of tools according to the preferred embodiment of the present invention.
Figure 2:
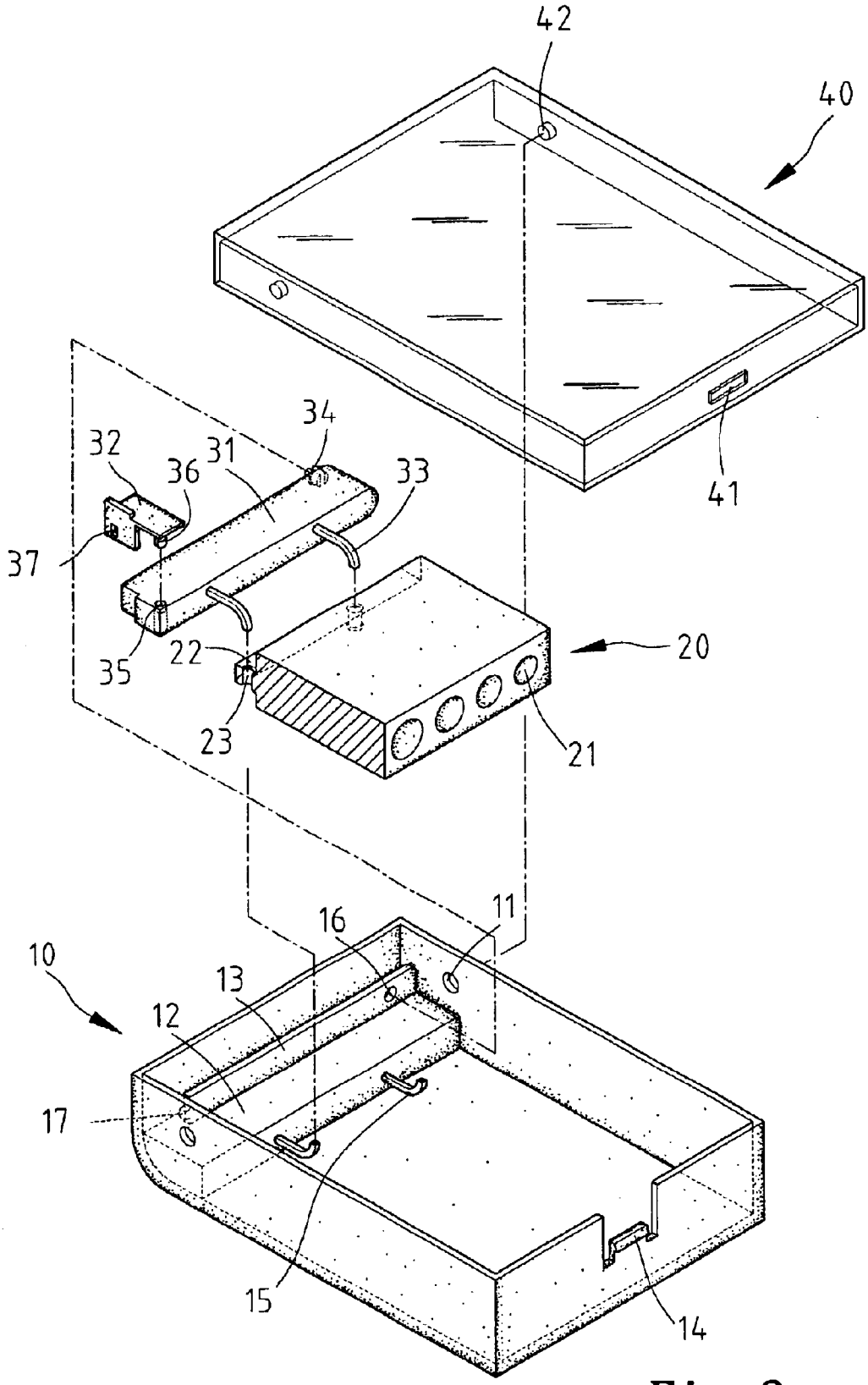
FIG. 2 is an exploded view of the toolbox shown in FIG. 1.

Referring to FIGS. 1 and 2, according to the preferred embodiment of the present invention, a toolbox includes a box or first shell 10, a holder 20 for holding a set of tools 50, a binder for retaining the holder 20 in the box 10 and a cover or second shell 40 for covering the box 10.

The box 10 includes a bottom (not numbered) and a wall (not numbered) formed on the bottom, two holes 11 defined in the wall and a protrusion 14 formed on the wall.

The holder 20 includes a plurality of recesses 21 defined in a side for holding tools, a tongue 22 formed on an opposite side and holes 23 defined in the tongue 22.

The binder includes a first claw 12 formed on the bottom of the box 10 and a second claw 31 for engagement with the first claw 12. Furthermore, the binder includes a lock 32 for locking the second claw 31 to the first claw 12.

The first claw 12 includes two crooks 15 extending from a side, a rib 13 extending from the top, a hole 16 defined in the rib 13 and a protrusion 17 extending longitudinally from the rib 13.

The second claw 31 includes two crooks 33 extending from a side, a boss 34 extending from an opposite side and a hole 35 defined therein.

The lock 32 includes a first tab (not numbered), a second tab (not numbered) extending transversely from the first tab, a boss 36 extending from the first tab and a hole 37 defined in the second tab.

The cover 40 includes a top (not numbered) and a wall (not numbered) extending from the top, two shafts 42 formed on the wall and a recess 41 defined in the wall.

The shafts 42 are inserted in the holes 11, thus pivotally mounting the cover 40 on the box 10. The protrusion 14 can be put in the recess 41, thus retaining the toolbox in a closed position.

Figure 4:
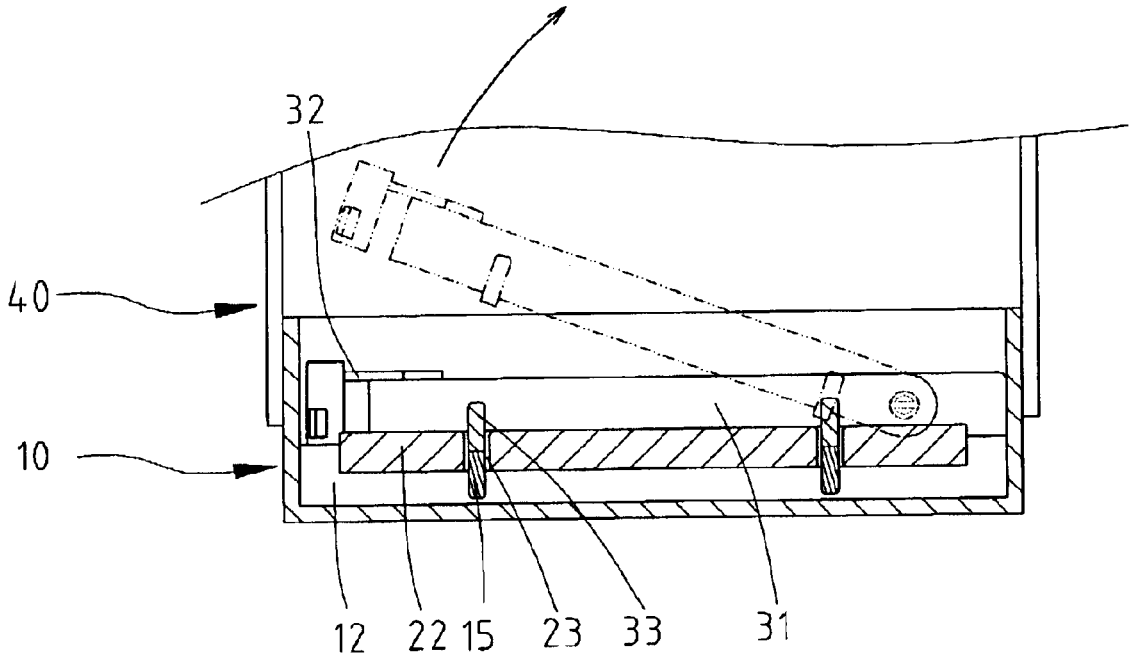
FIG. 4 is a cross-sectional view taken along a line 4—4 in FIG. 3 of the toolbox shown in FIG. 1 in an open position.

The boss 34 is inserted in the hole 16, thus pivotally mounting the second claw 31 on the first claw 12 as best shown in FIG. 4. The holder 20 can be put in the box 10 so that the crooks 15 are inserted in the holes 23. The second claw 31 can be pivoted to the first claw 12 so that the crooks 33 are inserted in the holes 23. Thus, the holder 20 is clamped by means of the first claw 12 and the second claw 31.

The boss 34 may include an enlarged end for better anchoring. The boss 34 may be divided into two halves by means of a slit (not numbered) for better flexibility.

Figure 3:
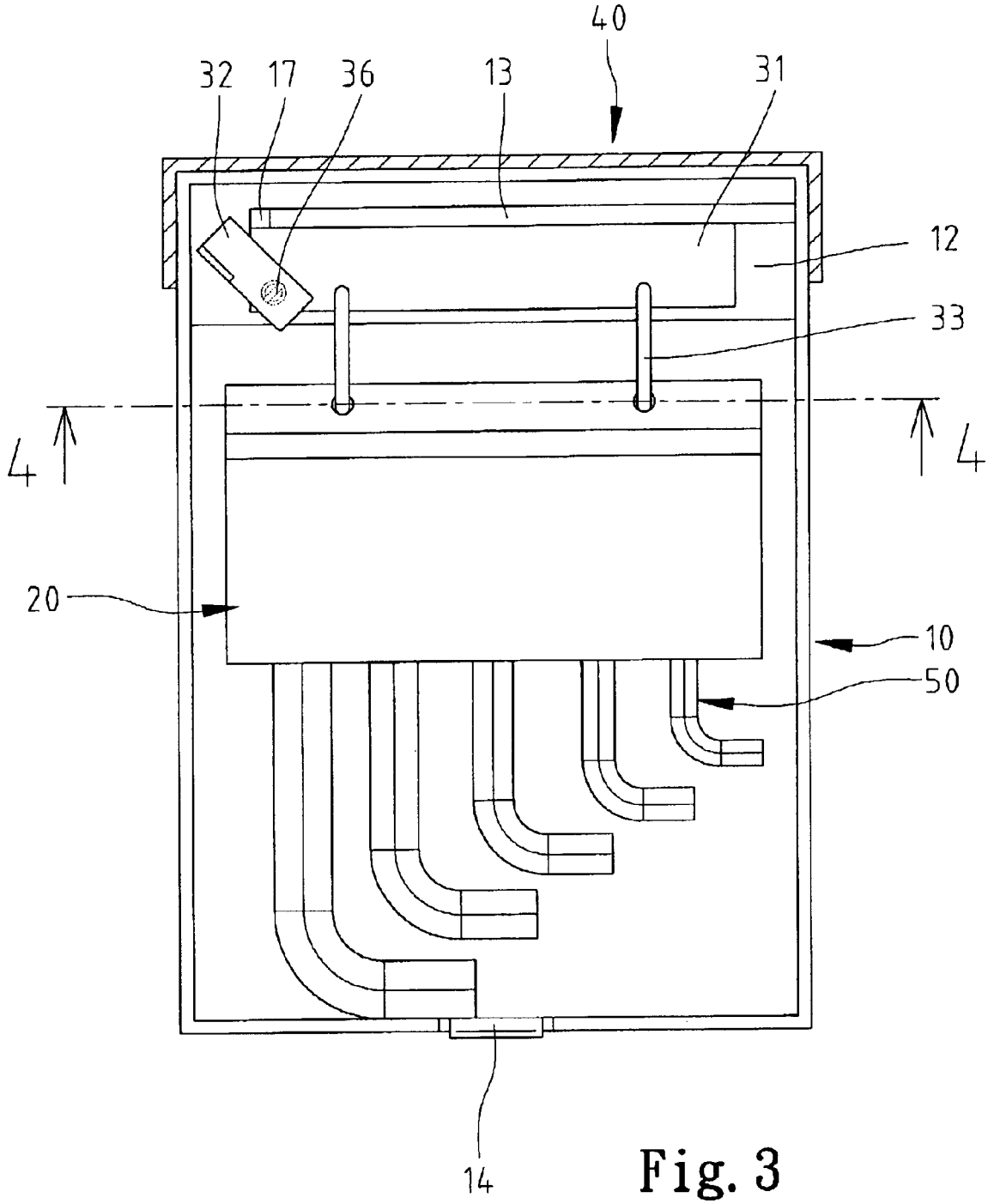
FIG. 3 is a top view of the toolbox shown in FIG. 1 in an open position and the cover shown in cross-section.

The boss 36 is inserted in the hole 35, thus pivotally mounting the lock 32 on the second claw 31 as best shown in FIG. 3. The lock 32 can be pivoted to the rib 13 so that the protrusion 17 is inserted in the hole 37, thus locking the second claw 31 to the first claw 12.

The boss 36 may include an enlarged end for better anchoring, and the hole 35 can include a configuration compliant with that of the boss 36. The boss 36 may be divided into two halves by means of a slit (not numbered) for better flexibility.

Figure 5:
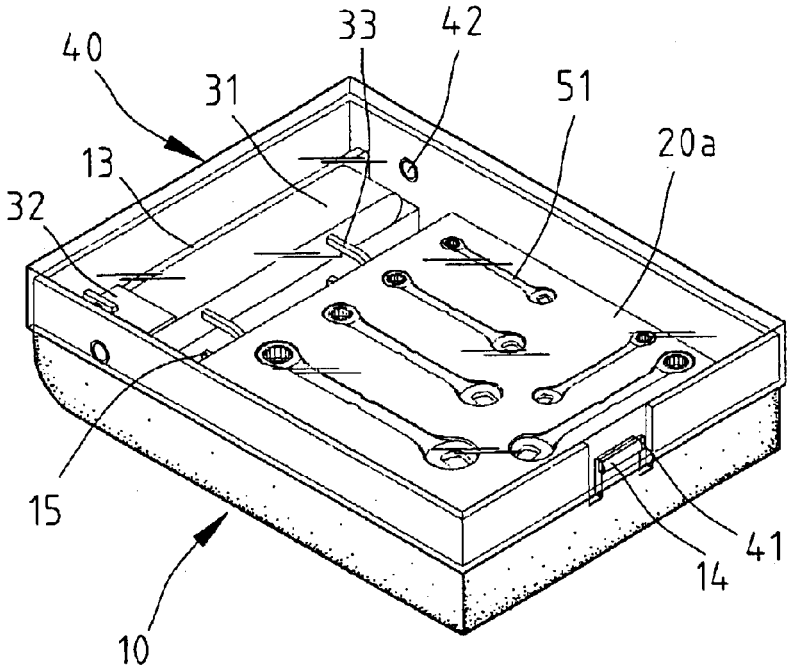
FIG. 5 is similar to FIG. 1 except for showing the toolbox containing a different set of tools.

Referring to FIG. 5, the holder 20*a* includes a different set of recesses defined in a side for receiving a different set of tools 51.

The present invention has been described through detailed illustration of the preferred embodiment. Those skilled in the art can derive variations from the preferred embodiment without departing from the scope of the present invention. Therefore, the preferred embodiment shall not limit the scope of the present invention defined in the claims.

What is claimed is:

1. A toolbox including a first shell, a second shell connected with the first shell, a holder for holding tools, a binder for retaining the holder in the shells in a releasable manner, wherein the binder includes a first claw and a second claw for engagement with the first claw in order to clamp the holder, wherein the first claw is pivotally connected with the second claw about a pivot axis, wherein the first claw includes a side extending radially from the pivot axis and having at least a first crook extending from the side radially spaced from the pivot axis, and the second claw includes a side extending radially from the pivot axis and having at least a first crook extending from the side radially spaced from the pivot axis and for engagement with the at least first crook of the first claw, and a lock for locking the second claw to the first claw, with the lock being radially spaced from the pivot axis.

2. The toolbox according to claim 1 wherein the first claw is attached to one of the shells.

3. The toolbox according to claim 2 wherein the first claw includes a rib formed thereon, with the pivot axis extending through the rib.

4. The toolbox according to claim 3 wherein the rib defines a hole, and the second claw includes a boss inserted in the hole defined in the rib, with the hole and the boss defining the pivot axis.

5. The toolbox according to claim 4 wherein the boss includes an enlarged end for better anchoring.

6. The toolbox according to claim 1 wherein the lock includes a first tab connected with one of the first and second claws and a second tab integrally extending from the first tab for engagement with the other of the first and second claws.

7. The toolbox according to claim 6 wherein the first tab is pivotally connected with the second claw and the second tab is for engagement with the first claw.

8. A toolbox including a first shell, a second shell connected with the first shell, a holder for holding tools and a binder for retaining the holder in the shells in a releasable manner, wherein the binder includes a first claw and a second claw for engagement with the first claw in order to clamp the holder, wherein the first claw is pivotally connected with the second claw, wherein the first claw includes a rib formed thereon and pivotally connected with the second claw, wherein the rib defines a hole, and the second claw includes a boss inserted in the hole defined in the rib, wherein the boss is divided into two halves by a slit for better flexibility.

9. A toolbox including a first shell, a second shell connected with the first shell, a holder for holding tools, a binder for retaining the holder in the shells in a releasable manner, wherein the binder includes a first claw and a second claw for engagement with the first claw in order to clamp the holder, and a lock for locking the second claw to the first claw, wherein the lock includes a first tab connected with the second claw and a second tab extending from the first tab for engagement with the first claw, wherein the first tab is pivotally connected with the second claw, wherein the first tab includes a boss formed thereon, and the second claw defines a hole for receiving the boss of the first tab.

10. The toolbox according to claim 9 wherein the boss includes an enlarged end for better anchoring.

11. The toolbox according to claim 9 wherein the boss is divided into two halves by a slit for better flexibility.

12. A toolbox including a first shell, a second shell connected with the first shell, a holder for holding tools, a binder for retaining the holder in the shells in a releasable manner, wherein the binder includes a first claw and a second claw for engagement with the first claw in order to clamp the holder, and a lock for locking the second claw to the first claw, wherein the lock includes a first tab connected with the second claw and a second tab extending from the first tab for engagement with the first claw, wherein the first claw includes a protrusion formed thereon, and the second tab defines a hole for receiving the protrusion of the first claw.

13. The toolbox according to claim 12 wherein the first claw includes a rib formed thereon, and the protrusion of the first claw extends from the rib.

14. A toolbox including a first shell, a second shell connected with the first shell a holder for holding tools, and a binder for retaining the holder in the shells in a releasable manner, wherein the binder includes a first claw and a second claw for engagement with the first claw in order to clamp the holder, wherein the first claw is pivotally connected with the second claw about a pivot axis, wherein the first claw includes a side extending radially from the pivot axis and having at least a first crook extending from the side radially spaced from the pivot axis, and the second claw includes a side extending radially from the pivot axis and having at least a first crook extending from the side radially spaced from the pivot axis and for engagement with the at least first crook of the first claw, wherein one of the first and second shells includes two shafts, and the other of the first and second shells defines two holes for receiving the shafts.

15. A toolbox including a first shell, a second shell connected with the first shell, a holder for holding tools, and a binder for retaining the holder in the shells in a releasable manner, wherein the binder includes a first claw and a second claw for engagement with the first claw in order to clamp the holder, wherein the first claw is pivotally connected with the second claw about a pivot axis, wherein the first claw includes a side extending radially from the pivot axis and having at least a first crook extending from the side radially spaced from the pivot axis, and the second claw includes a side extending radially from the pivot axis and having at least a first crook extending from the side radially spaced from the pivot axis and for engagement with the at least first crook of the first claw, wherein one of the first and second shells includes a protrusion, and the other of the first and second shells defines a recess for receiving the protrusion.

* * * * *